US005701948A

United States Patent [19]

Strezov et al.

[11] Patent Number: 5,701,948

[45] Date of Patent: Dec. 30, 1997

[54] CASTING STEEL STRIP

[75] Inventors: Lazar Strezov, Adamstown; Rama Ballav Mahapatra, Yarrawarrah; Fred de Sylva; Kannappar Mukunthan, both of Merewether, all of Australia

[73] Assignees: Iskikawajima-Harima Heavy Industries Company Limited, Tokyo, Japan; BHP Steel (JLA) Pty Ltd., Melbourne, Australia

[21] Appl. No.: 633,949

[22] Filed: Apr. 17, 1996

[30] Foreign Application Priority Data

May 5, 1995 [AU] Australia ..... PN2811

[51] Int. Cl.[6] ..... B27D 11/06

[52] U.S. Cl. ..... 164/480; 164/428

[58] Field of Search ..... 164/480, 428, 164/479, 429, 463, 423

[56] References Cited

FOREIGN PATENT DOCUMENTS 2-165849 6/1990 Japan .

*Primary Examiner*—Kuang Y. Lin

*Attorney, Agent, or Firm*—Nikaido Marmelstein Murray & Oram, Ltd.

[57] ABSTRACT

In continuous casting of steel strip, a casting pool of molten metal is supported on moving casting surfaces which are chilled to cause solidification of steel on the casting surfaces. The casting surfaces are textured by provision of parallel groove and ridge formations (11) defining V-shaped grooves (12) and ridges (13) with sharp edges (14). The depth (d) of the texture from ridge peak to groove root is in the range 5 to 50 microns and the pitch (p) between the grooves is in the range 100 to 250 microns. The casting surfaces may be peripheral surfaces of casting rolls of a twin roll caster.

24 Claims, 18 Drawing Sheets

TRANSVERSE SECTION MAGINIFICATION × 500

LONGITUDINAL SECTION MAGINIFICATION × 500

CASTING STEEL STRIP

BACKGROUND OF THE INVENTION

This invention relates to the casting of steel strip.

It is known to cast metal strip by continuous casting in a twin roll caster. In this technique molten metal is introduced between a pair of contra-rotated horizontal casting rolls which are cooled so that metal shells solidify on the moving roll surfaces end are brought together at the nip between them to produce a solidified strip product delivered downwardly from the nip between the rolls. The term "nip" is used herein to refer to the general region at which the rolls are closest together. The molten metal may be poured from a ladle into a smaller vessel from which it flows through a metal delivery nozzle located above the nip so as to direct it into the nip between the rolls, so forming a casting pool of molten metal supported on the casting surfaces of the rolls immediately above the nip and extending along the length of the nip. This casting pool is usually confined between side plates or dams held in sliding engagement with end surfaces of the rolls so as to dam the two ends of the casting pool against outflow, although alternative means such as electromagnetic barriers have also been proposed.

Although twin roll casting has been applied with some success to non-ferrous metals which solidify rapidly on cooling, there have been problems in applying the technique to the casting of ferrous metals. One particular problem has been the achievement of sufficiently rapid and even cooling of metal over the casting surfaces of the rolls. In particular it has proved difficult to obtain sufficiently high cooling rates for solidification onto casting rolls with smooth casting surfaces and it has therefore been proposed to use rolls having casting surfaces which are deliberately textured by the formation of regularly spaced projections to enhance heat transfer and so increase the heat flux achieved at the casting surfaces during solidification.

When casting ferrous metals into thin strip, the heat flux on solidification is not the only important criterion and it can be very important to obtain a fine microstructure, particularly if the resulting strip is to be worked or used in the "as cast" condition without subsequent heat treatment. More specifically, it is desirable to avoid a coarse grain structure in the as cast strip and ideally to achieve a fine austenitic structure.

We have made a detailed study of the solidification of ferrous metals on textured surfaces which has enabled us to develop a very particular kind of textured casting surface which enables optimisation of both heat flux and microstructure during metal solidification in a twin roll caster. The desired texture is a series of groove and ridge formations extending circumferentially of the casting surfaces of the rolls.

It is known to provide the casting rolls of a twin roll caster with circumferential grooves for the purpose of avoiding surface defects in the resulting strip. Examples of such proposals are seen in Japanese Patent Publication 91-128149 of Ishikawajima-Harima Heavy Industries Company Limited, U.S. Pat. No. 4,865,117 to Bartlett et al and U.S. Pat. No. 5,010,947 to Yukumoto et al. However, all of these publications contemplate grooves of much larger size arranged at a much greater pitch spacing than is contemplated by the very fine texture groove and ridge formations developed by the present invention.

Japanese Publication 91-128149 proposes grooves having a depth of the order of 0.2 mm and a pitch of 0.6 mm with the purpose of causing the molten metal to span the grooves without touching their bottom parts so as to leave clear spaces between the molten metal and most of the groove surfaces. It is said that this reduces heat conduction on initial solidification and prevents longitudinal cracking caused by excessive thermal gradients.

U.S. Pat. No. 4,865,117 also proposes the provision of grooves such that the liquid metal does not completely fill the grooves during solidification. The grooves are arranged at a frequency of 8 to 35 grooves per centimeter measured axially along the roll surface which equates to a pitch well in excess of 1 mm. This specification contemplates grooves having a depth of up to 2 mm and a groove width in excess of 0.15 mm. These measurements produce a groove pattern which is far coarser than that contemplated by the fine texture provided by the present invention.

U.S. Pat. No. 5,010,947 discloses groove rolls in which the grooves of one roll are out of phase with the grooves of the other. In practice, this requires that the grooves be spaced relatively far apart compared with their width and although the specification specifies extremely wide possible ranges for groove width, depth and pitch this specification contemplates grooves to a greater size and set at a much greater pitch spacing than fine texture groove and ridge formations of quite specific depth and pitch as contemplated by the present invention.

The use of textured casting surfaces in a twin roll caster to achieve high heat flux values on solidification can lead to a defect in the cast strip known as "crocodile skin" which is due to localised excessive cooling at particular points on the textured casting surfaces and consequent localised deformation at points spread over the strip surface. Our detailed study of solidification of ferrous metals on textured surfaces has also shown that this kind of defect can be alleviated by the controlled addition of sulphur to the melt. As explained later in this specification, increasing the sulphur content delays the onset of roll oxide melting which is responsible for the localised excessive cooling.

Although the optimised casting surface texture developed by the present invention has particular application to twin roll casting it can also be applied in similar casting techniques in which a casting pool of molten steel is formed in contact with a moving casting surface such that steel solidifies from the pool onto the moving casting surface. This may occur for example in a single roll drag caster or a moving belt caster.

SUMMARY OF THE INVENTION

According to the invention there is provided a method of continuously casting steel strip comprising supporting a casting pool of molten steel on one or more chilled casting surfaces, and moving the chilled casting surface or surfaces to produce a solidified strip moving away from the casting pool, wherein the or each casting surface is textured by the provision of parallel groove and ridge formations of essentially constant depth and pitch, the depth of the texture from ridge peak to groove root being in the range 5 microns to 50 microns, and said pitch being in the range 100 to 250 microns.

The casting pool may be supported on peripheral casting surfaces of a pair of chilled casting rolls forming a nip between them and rotated in mutually opposite directions to produce the solidified strips such that it moves downwardly from the nip.

The groove and ridge formations in each casting surface may be defined by a series of parallel annular grooves extending circumferentially around the casting surface and regularly spaced longitudinally of the casting surface at said pitch.

Alternatively, the groove and ridge formations in each casting surface may be defined by one or more grooves extending helically of the casting surface.

Preferably, the groove formations are of substantially V-shaped cross-section and the ridge formations have sharp circumferential edges.

For optimum results it is preferred that the depth of the texture is in the range 15 to 25 microns and the pitch is between 150 and 200 microns. Optimum results have been achieved with rolls in which the depth of the texture is 20 microns and the pitch between adjacent grooves is 180 microns.

For the purpose of controlling crocodile skin type defects the molten metal may be molten steel having a sulphur content of at least 0.02% . Specifically, the steel may be a silicon/manganese killed steel having a manganese content of not less than 0.20% and a silicon content of not less than 0.10% by weight and a sulphur content of not less than 0.03% by weight. The sulphur content may be in the range 0.03–0.07% by weight.

The invention also extends to apparatus for continuously casting metal strip comprising a pair of casting rolls forming a nip between them, a metal delivery nozzle for delivery of molten metal into the nip between the casting rolls to form a casting pool of molten metal supported on casting roll surfaces immediately above the nip, and roll drive means to drive the casting rolls in counter-rotational directions to produce a solidified strip of metal delivered downwardly from the nip, wherein the casting surfaces of the rolls are textured by the provision of circumferentially extending groove and ridge formations of constant depth and pitch, the depth of the texture form ridge peak to groove root being in the range 5 microns to 50 microns, and said pitch being in the range 100 to 250 microns.

BRIEF DESCRIPTION OF THE DRAWINGS

In order that the invention may be more fully explained its application to the casting of thin steel strip in a twin roll caster will be described with reference to the accompanying drawings in which.

DESCRIPTION OF PREFERRED EMBODIMENT

Figure 1:
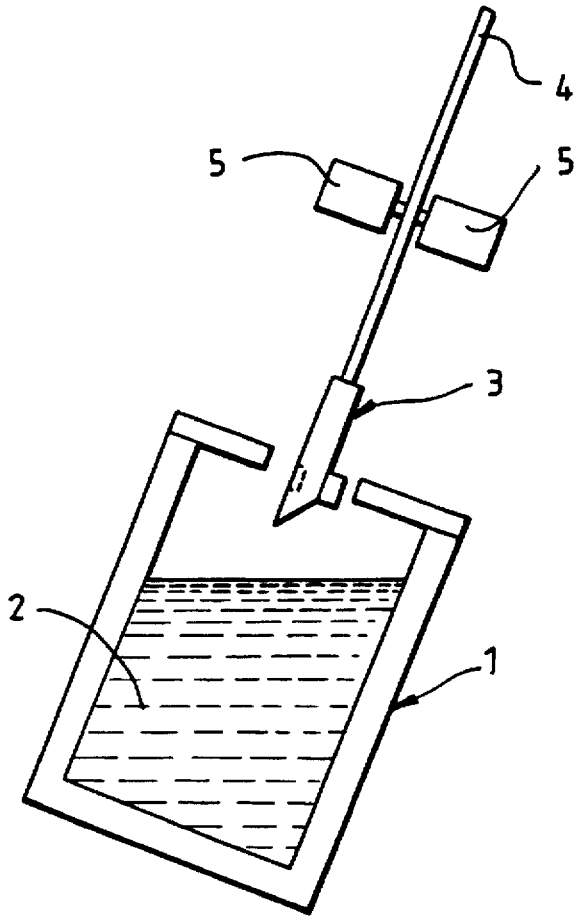
FIG. 1 illustrates experimental apparatus for determining metal solidification rates under conditions simulating those of a twin roll caster.
Figure 2:
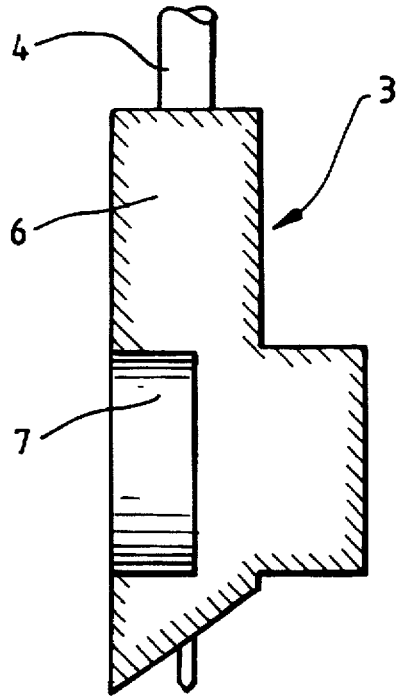
FIG. 2 illustrates an immersion paddle incorporated in the experimental apparatus of FIG. 1.

FIGS. 1 and 2 illustrate a metal solidification test rig in which a 40 mm ×40 mm chilled block is advanced into a bath of molten steel at such a speed as to closely simulate the conditions at the casting surfaces of a twin roll caster. Steel solidifies onto the chilled block as it moves through the molten bath to produce a layer of solidified steel on the surface of the block. The thickness of this layer can be measured at points throughout its area to map variations in the solidification rate and therefore the effective rate of heat transfer at the various locations. It is thus possible to produce an overall solidification rate as well as total heat flux measurements. It is also possible to examine the microstructure of the strip surface to correlate changes in the solidification microstructure with the changes in observed solidification rates and heat transfer values.

The experimental rig illustrated in FIGS. 1 and 2 comprises an induction furnace 1 containing a melt of molten metal 2 in an inert atmosphere of argon gas. An immersion paddle denoted generally as 3 is mounted on a slider 4 which can be advanced into the melt 2 at a chosen speed and subsequently retracted by the operation of computer controlled motors 5.

Immersion paddle 3 comprises a steel body 6 which contains a substrate 7 in the form of a chrome plated copper disc of 46 mm diameter and 18 mm thickness. It is instrumented with thermo-couples to monitor the temperature rise in the substrate which provides a measure of the heat flux.

Extensive testing has been carried out on the experimental rig illustrated in FIGS. 1 and 2 to investigate the solidification of ferrous metals to substrates of various textures as well as on to smooth substrates. This testing, together with theoretical analysis, has demonstrated that enhanced heat flux on solidification can be achieved by using textured casting surfaces and that when casting ferrous metals there is an optimum texture which produces high total heat flux values on solidification combined with a fine microstructure in the as cast product. These results have been confirmed by operation of a twin roll caster provided with casting rolls having smooth and textured casting surfaces, including the preferred kind of texture which provides optimum results.

Figure 3:
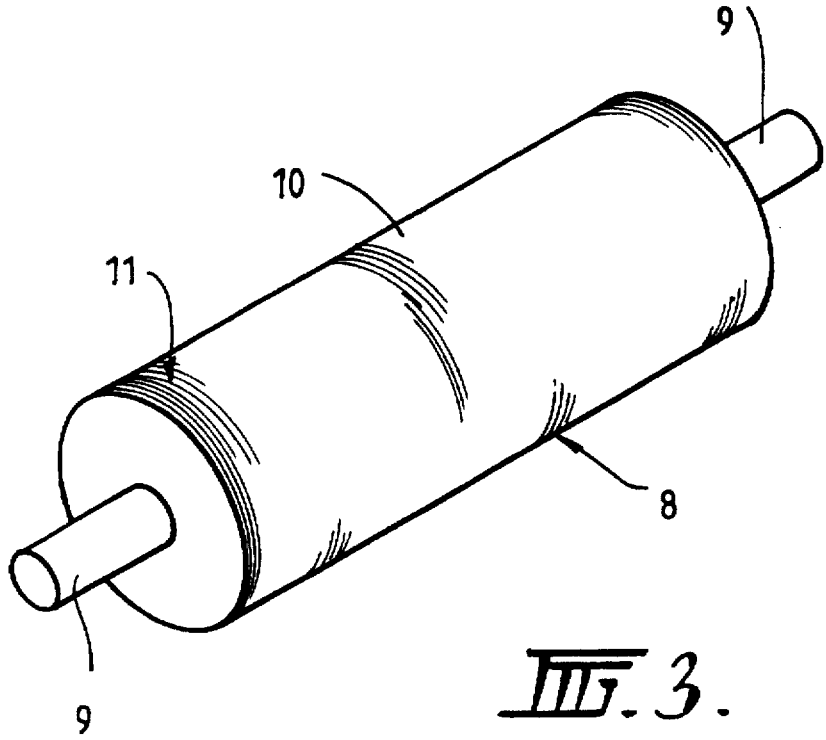
FIG. 3 illustrates a casting roll with a preferred form of textured surface.
Figure 4:
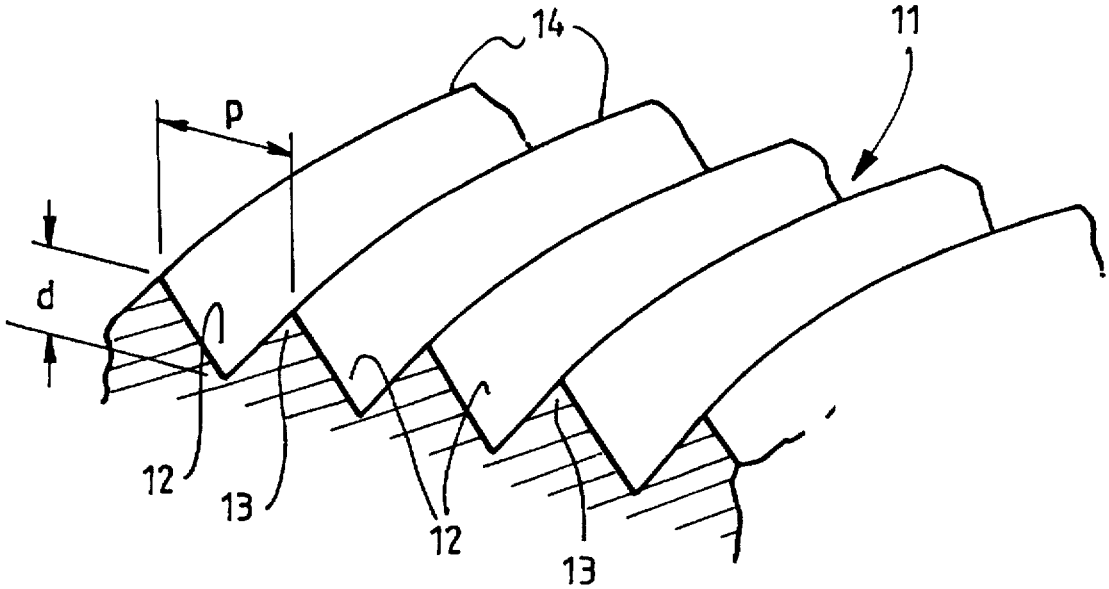
FIG. 4 is an enlarged schematic diagram of the preferred kind of texture.

The preferred form of texture is illustrated diagrammatically in FIGS. 3 and 4 in which FIG. 3 illustrates a casting roll 8 provided with support shafts 9 and a circumferential casting surface 10 provided with circumferential groove and ridge formations 11.

The groove and ridge formations are shown to an enlarged scale in FIG. 4. They define a series of circumferential grooves 12 of V-shaped cross-section and between the grooves a series of parallel ridges 13 having sharp circumferential edges 14. The grove and ridge formations define a texture having a depth from ridge peak to groove root indicated as d in FIG. 4. The pitch between the regularly spaced ridges is indicated by p in FIG. 4. Optimum dimensions for the texture depth d and pitch p have been determined in the manner to be described.

Figure 5:
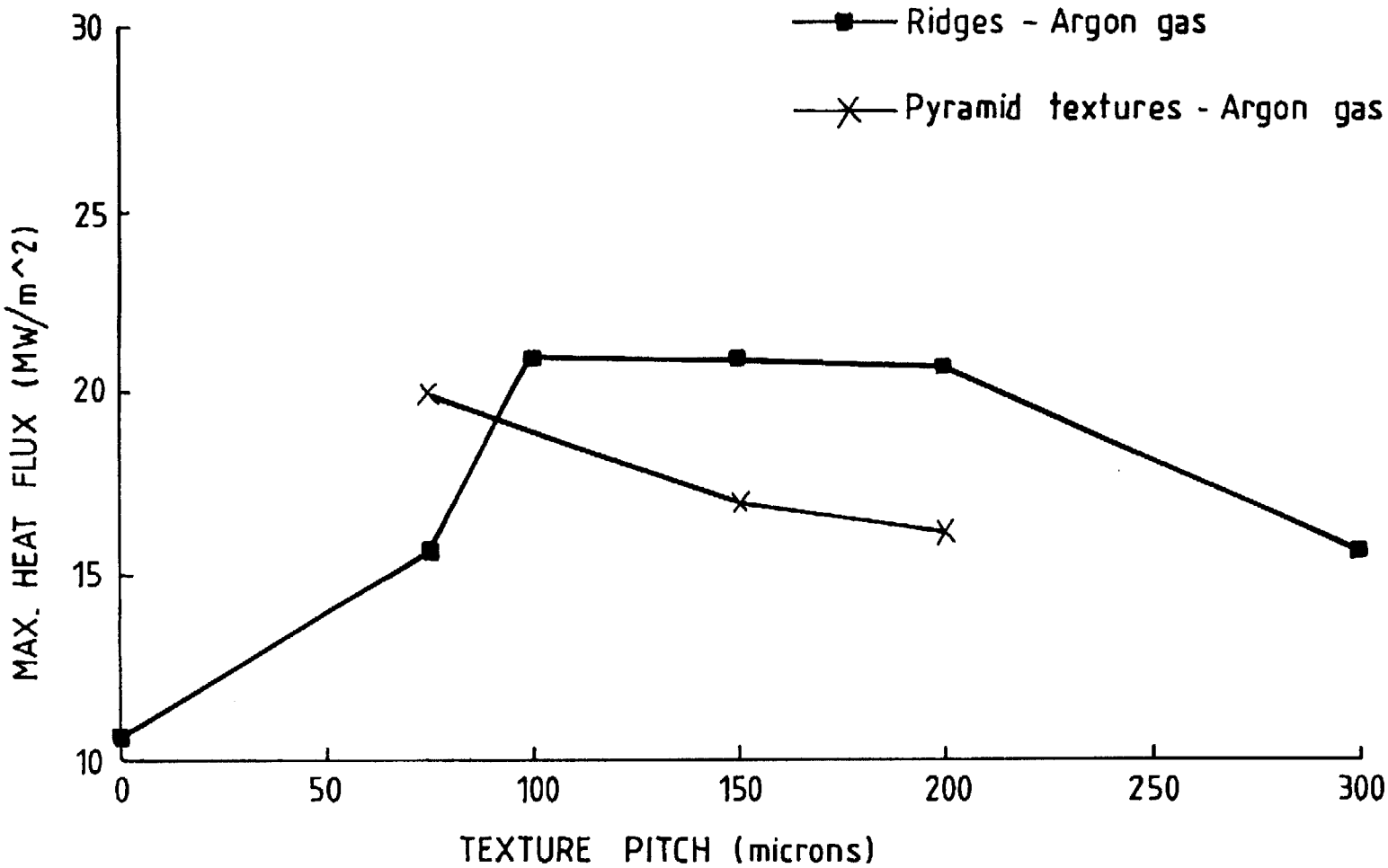
FIG. 5 plots heat flux values obtained during solidification of steel samples on substrates of differing surface finish.

FIG. 5 presents results of typical tests on solidification of manganese/silicon killed steels on to smooth and textured substrates. More specifically this figure indicates the heat flux values obtained through the time interval during solidification on a smooth substrate, a ridged substrate of the formation illustrated in FIG. 3 and a substrate provided with a texture in the form of discrete pyramidal projections. It will be seen that the ridged texture produces clearly enhanced heat flux values compared with both the smooth substrate and the substrate with the discrete projections. This result has been obtained consistently in extensively testing with various substrates and the highest heat flux values are obtained with a substrate textured by essential parallel continuous ridges. Careful examination of the resulting microstructures shows that with a texture formed by continuous parallel ridges, the sharp edges of the ridges provide lines of closely spaced nucleation sites during metal solidification.

Figure 6:
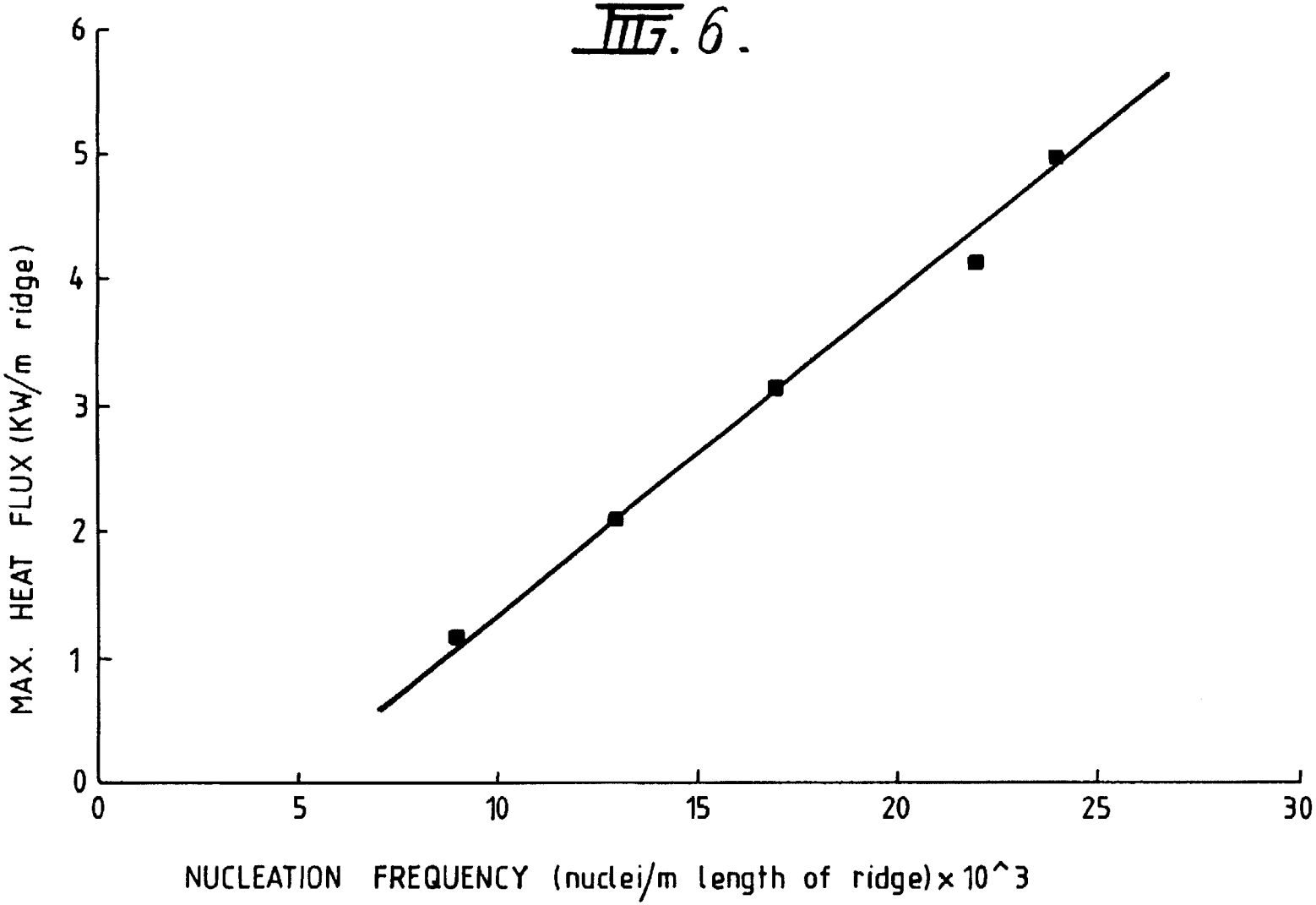
FIG. 6 indicates maximum heat flux values obtained at differing nucleation frequencies both as measured along a line of nucleation sites in solidified steel samples.
Figure 7:
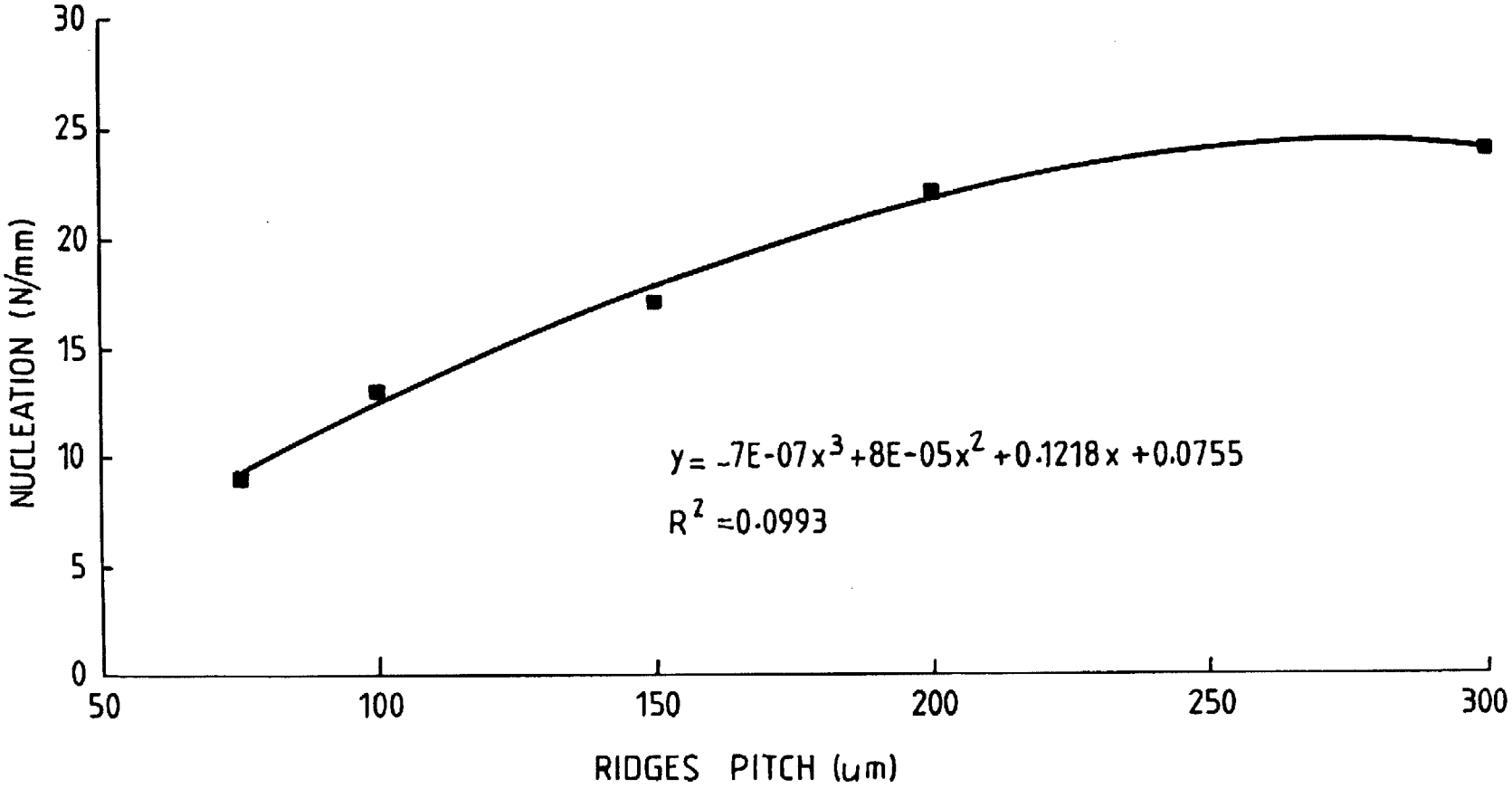
FIG. 7 indicates typical values of nucleation frequency along each ridge for differing ridge pitches.

The spacing or frequency of the nucleation sites along the ridges determines the maximum heat flux obtained during solidification. FIG. 6 demonstrates this effect by plotting maximum heat flux values obtained against observed nucleation frequency measured along the lines in the solidified product corresponding with the ridges of the texture. It will be seen that the maximum heat flux obtained along a single ridge is directly proportional to the nucleation frequency along that ridge. Further testing has shown that the nucleation frequency along each ridge depends on the pitch between the ridges end that as the pitch decreases there will be a corresponding increase in the nucleation spacing along each ridge. FIG. 7 plots typical results of nucleation frequency along each ridge plotted against ridge pitch for varying ridged substrates.

Figure 8:
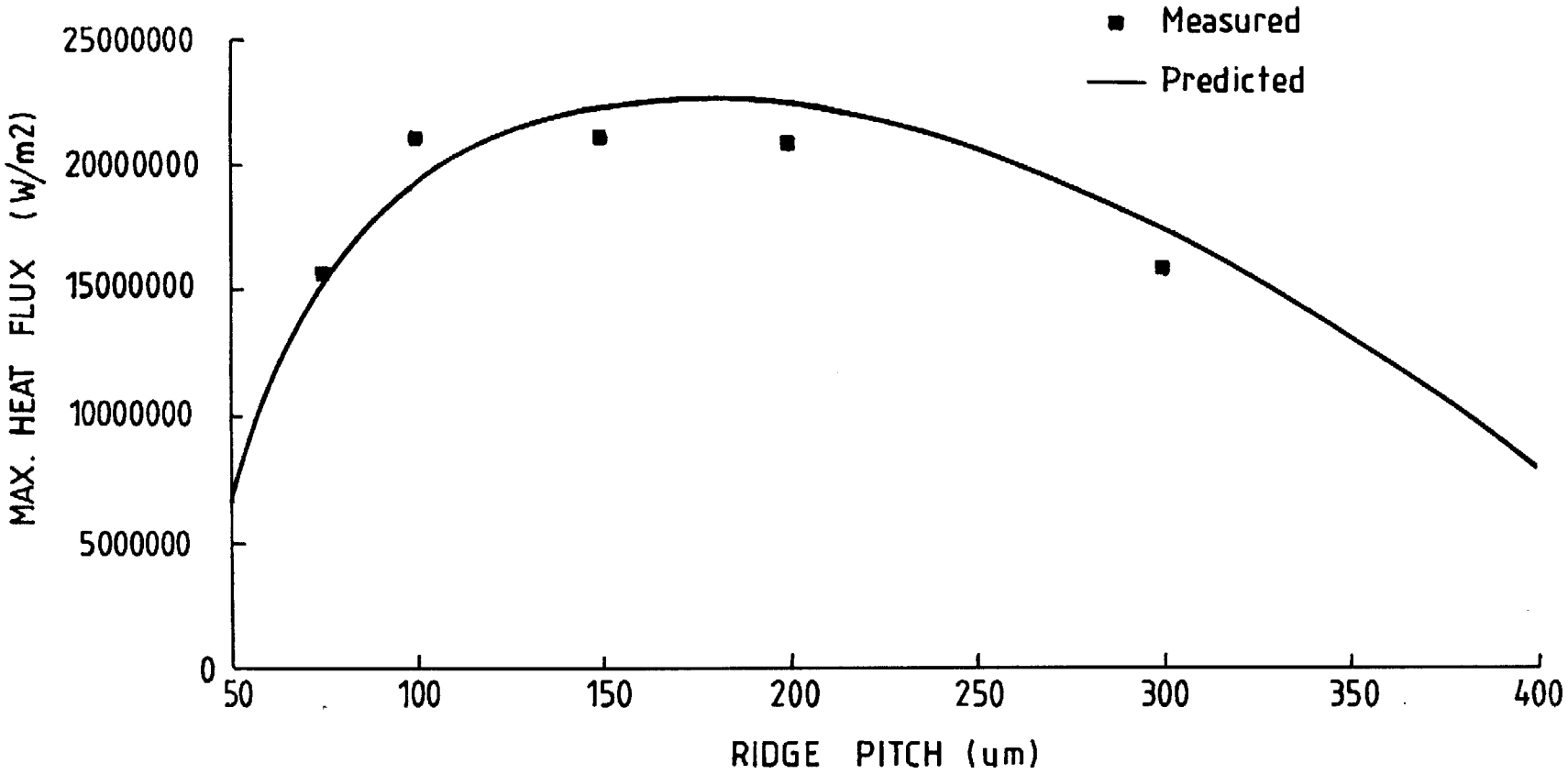
FIG. 8 plots predicted and actual values of heat flux against ridge pitch for typical steel samples.

The actual heat flux obtained over a surface area of the substrate will be determined by the number of nucleation sites per unit area. By combining the results of FIGS. 6 and 7 it is possible to predict the heat flux values for various ridge pitches. FIG. 8 plots the resulting prediction of heat flux plotted against ridge pitch and compares that with actual measured values of heat flux for specific ridge pitches within the range 50 to 300 microns. It will be seen that the observed values fit very closely with the prediction and that optimum heat flux values are obtained if the ridge pitch is between about 100 microns and 250 microns.

In order to obtain optimum results it is necessary to consider the microstructure of the resulting cast product. Our study of the solidification of a wide range of steels on ridged substrates has shown that the ridge formations cause solidification to proceed in a unique way which enables a much finer microstructure to be achieved than with smooth surfaces or textured surfaces of other kinds and also explains why higher heat flux values can be obtained with the ridged texture.

Figure 9:
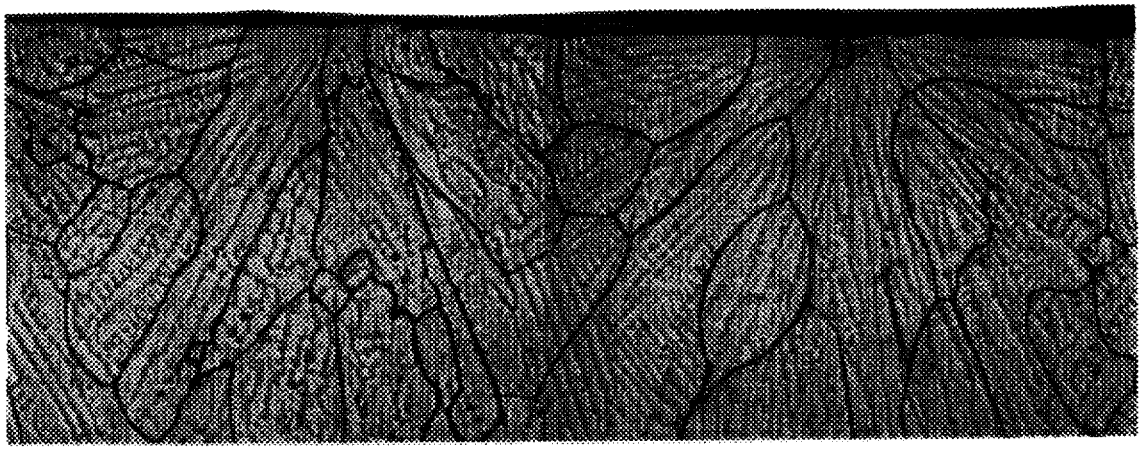
FIGS. 9 and 10 are photomicrographs showing grain structures obtained by casting steel onto a ridged substrate.
Figure 10:
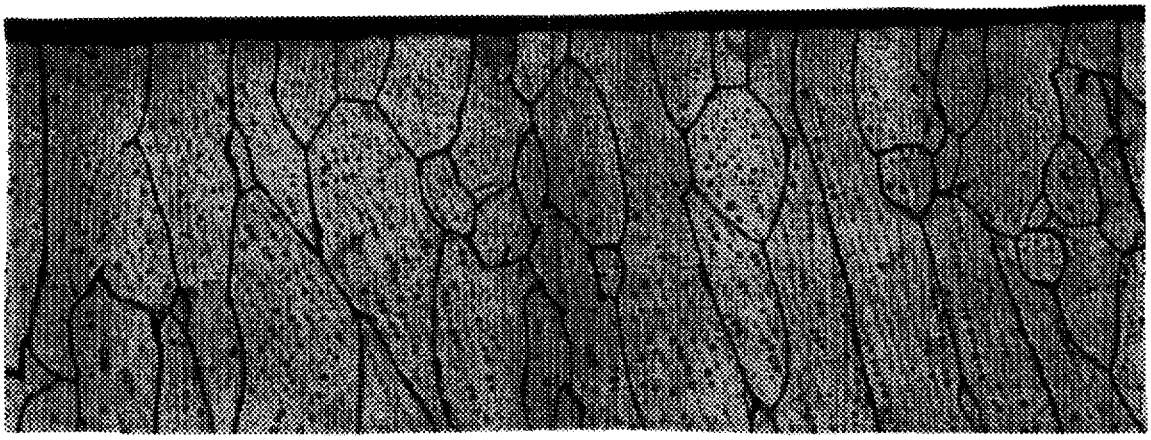

On substrates which are smooth or which are textured by discrete projections, solidification will proceed by growth of a single austenitc grain at each nucleation site and the final austenitc grain size will be determined by the spacing of the nucleation sites. However, with a ridged texture several grains grow from each nucleation site. More specifically, several grains radiate outwardly from each nucleation site in a plane transverse to the ridge edge to form a fan-shaped array of outwardly radiating grains. Further elongate grains grow from the nucleation sites in the directions longitudinally of the ridges. This kind of grain growth is demonstrates in FIGS. 9 and 10 which are photomicrographs of steels cast onto a ridged substrates and on which the grain boundaries have been indicated. FIG. 9 shows a section taken transverse to the direction of the ridges in the substrate and shows the fanning grain growth pattern whereas the section of FIG. 10 is taken longitudinally of the ridges and shows the generally parallel elongate grain growth in that direction.

Figure 11:
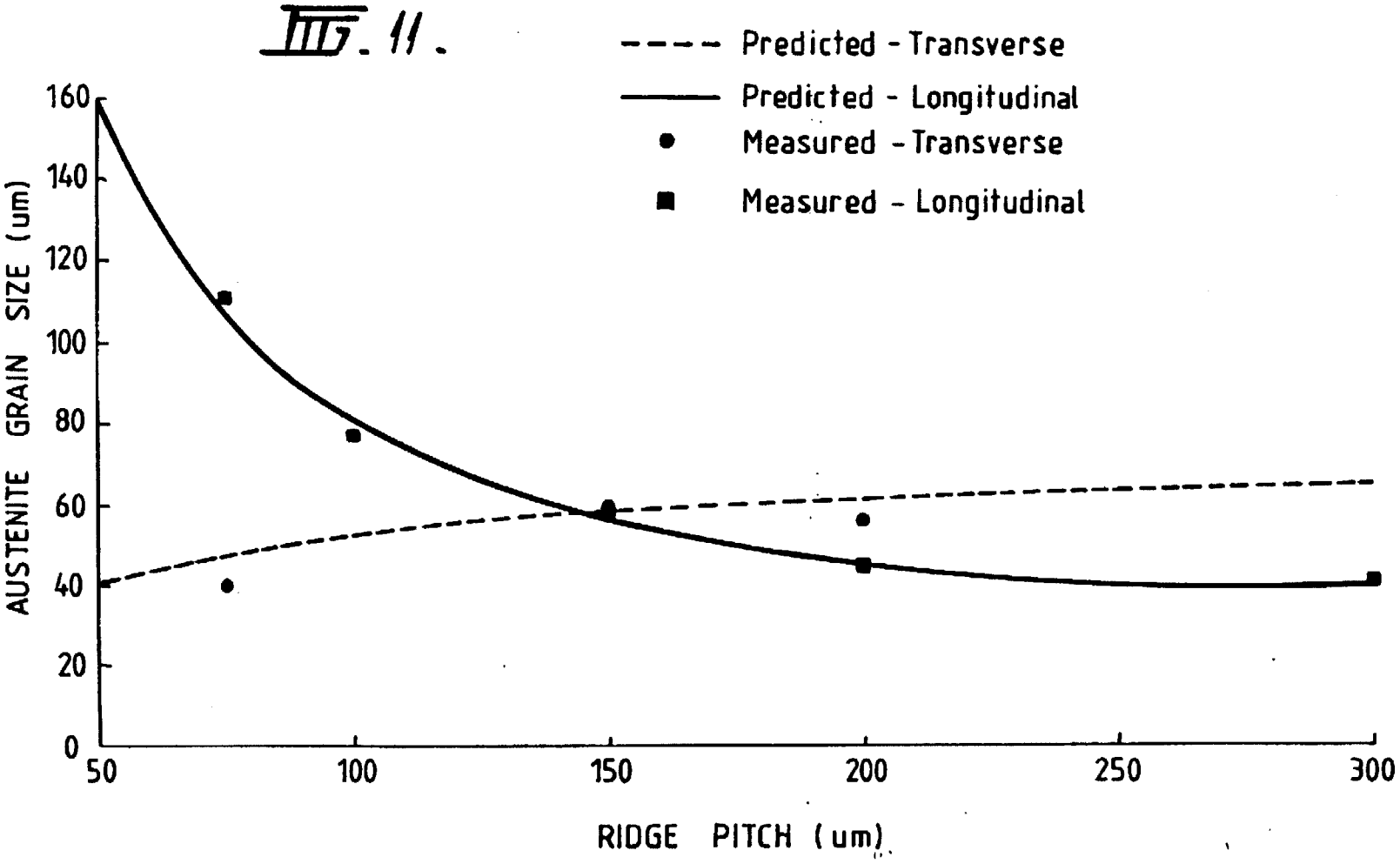
FIG. 11 indicates predicted austenite grain sizes in directions transverse to and along the ridges of a ridge substrate together with actual values measured on solidification of austenitic stainless steel.
Figure 12:
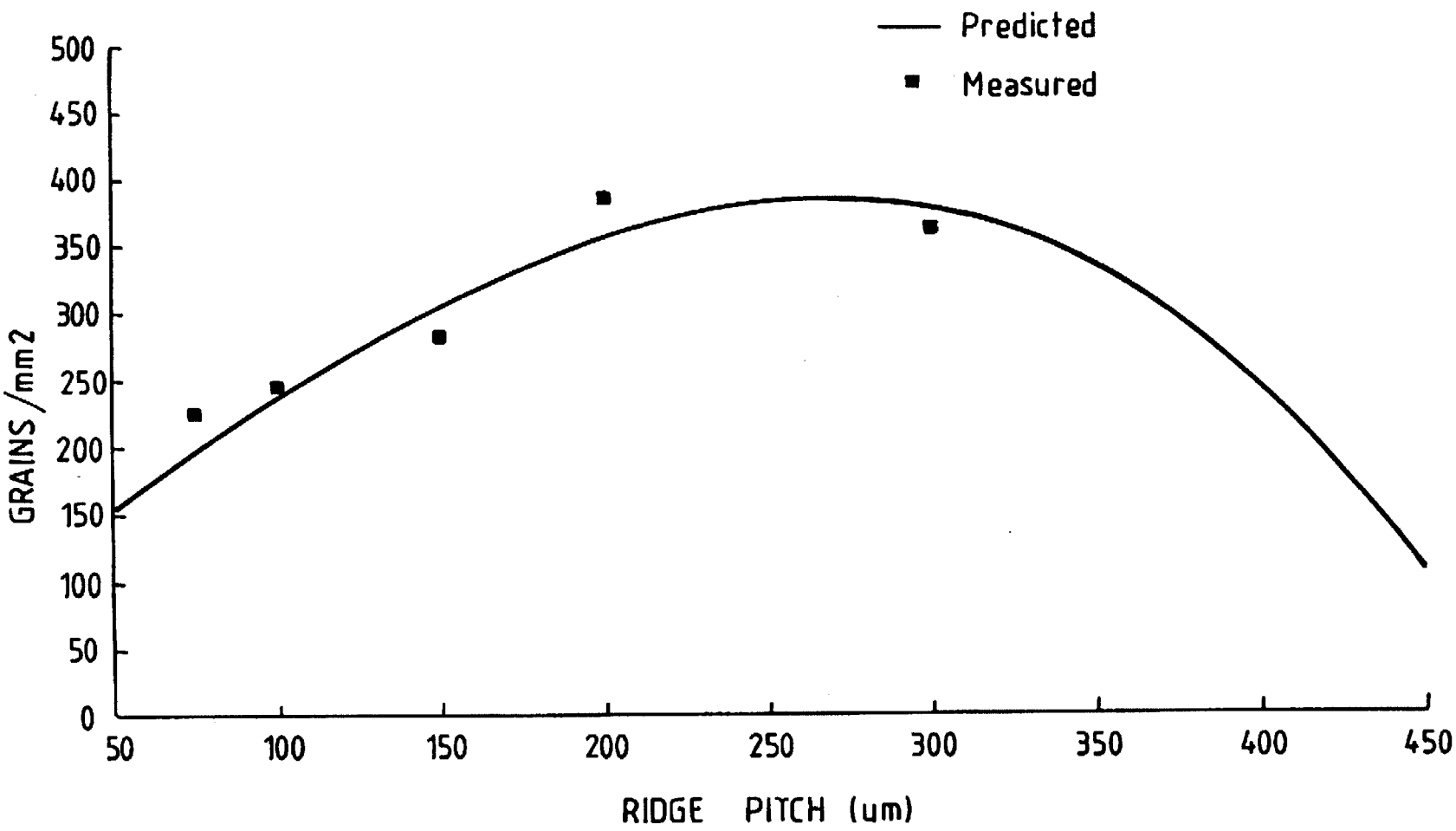
FIG. 12 indicates predicted grain size variations for differing ridge pitches together with actual values measured in austenitic stainless steel samples.

To obtain a fine microstructure it is necessary to maximise the number of grains per unit of area. The packing of the grains within a unit area will be dependent on the ridge pitch and can be predicted given the known relationship between the nucleation frequency and ridge pitch. FIG. 11 indicates predicted austenite grain sizes in the directions transverse to and along the substrate ridges together with actual values measured on solidification of austenitic stainless steel. It will be seen that there is a very close correlation between the prediction and the measured values which confirms the solidification mechanism. With these results it is possible by considering the packing of austenite grains throughout the area of the substrate to predict the relationship between the number of grains and ridge pitch. FIG. 12 plots the resulting prediction together with actual values measured in austenitic stainless steel solidified onto ridged substrates of differing pitches. It will be seen that the correlation between the prediction and the observed results is very close and that in order to obtain a fine grain size the ridge pitch should be between about 100 microns and 350 microns and preferably between 150 and 250 microns. On comparing these results with the range of 100 to 250 microns determined to provide good heat flux values it will be appreciated that in order to obtain both good heat flux and fine microstructure it is most desirable that the ridge pitch be in the range 150 to 250 microns.

Choice of an appropriate depth of texture is determined primarily by two considerations. Firstly, it is necessary to considering the accuracy to which the texture profile can be machined and the effect of inaccuracies of the contact between the molten metal and the textured surface which influences the creation of solidification nucleation sites. Secondly, increasing depth of texture will increase the resistance to heat flow across the textured substrate which will have a direct effect on heat flux. Inaccuracies in machining of the ridges can result in the molten metal interface spanning relatively high ridges without actually touching lower ridges in between with a consequent loss of nucleation sites. The molten metal interface will sag between the supporting ridges and it can be calculated that for texture pitches of between 150 and 250 microns the metal sag between supporting ridges may be of the order of 0.1 to 0.5 microns. The shallower the texture of the substrate the more likely that sagging of this magnitude over two ridge pitch lengths will cause the metal to make contact with the intermediate ridge. Expressed in another way, shallow textures can be machined to a wider error tolerance than can deeper textures without loss of contact and nucleation sites. On the other hand as the texture becomes more shallow it approaches a smooth surface and if the depth approaches about 5 microns the nature of the solidification changes away from that produced by ordered lines of nucleation sites at which multiple grains can be grown. The solidification then approaches that of obtained by a smooth surface with a consequent loss of heat flux and a significant coarsening of the microstructure.

Figure 13:
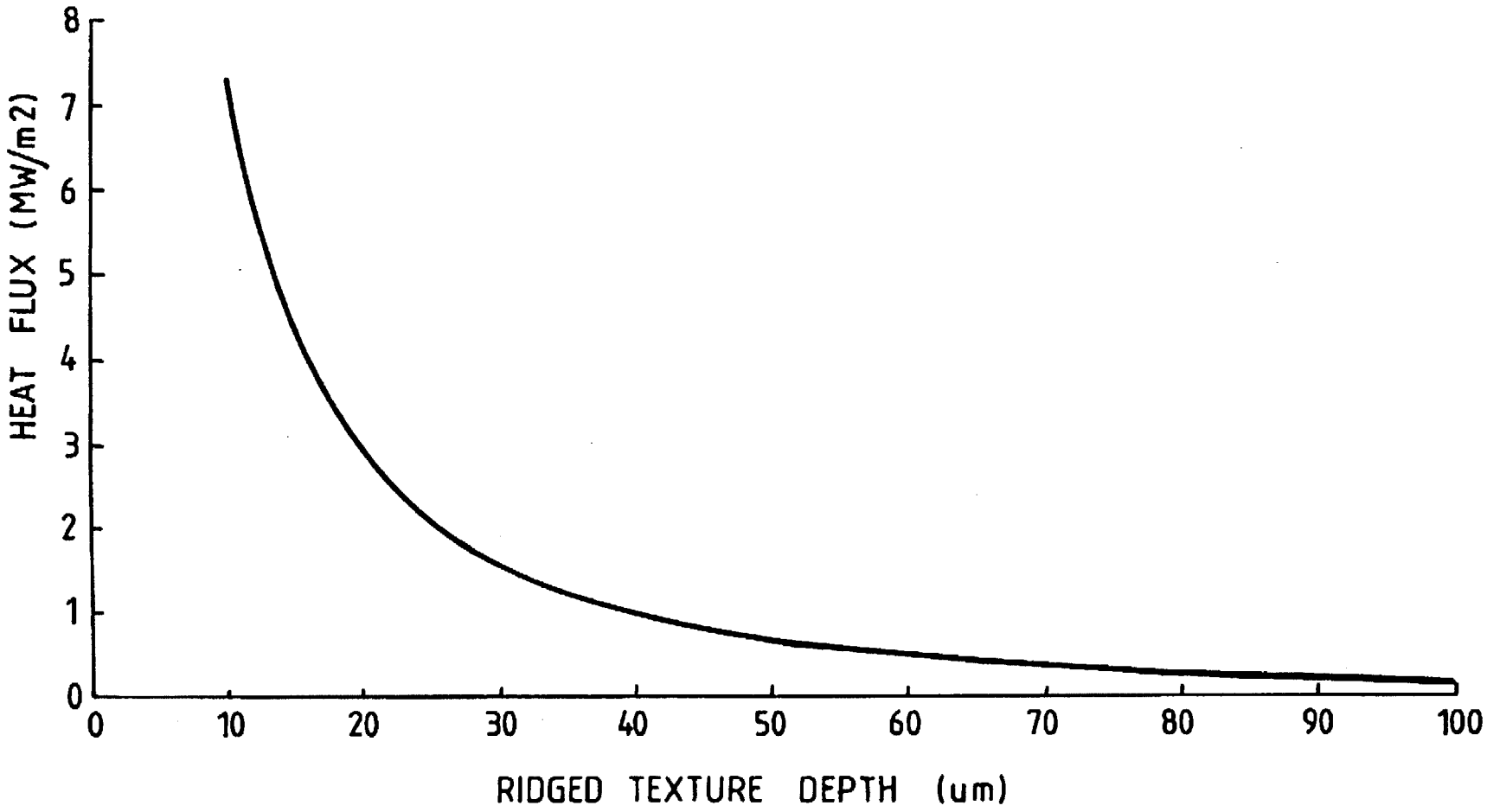
FIG. 13 plots calculated heat flux values across the texture valleys for a range of texture depths.
Figure 14:
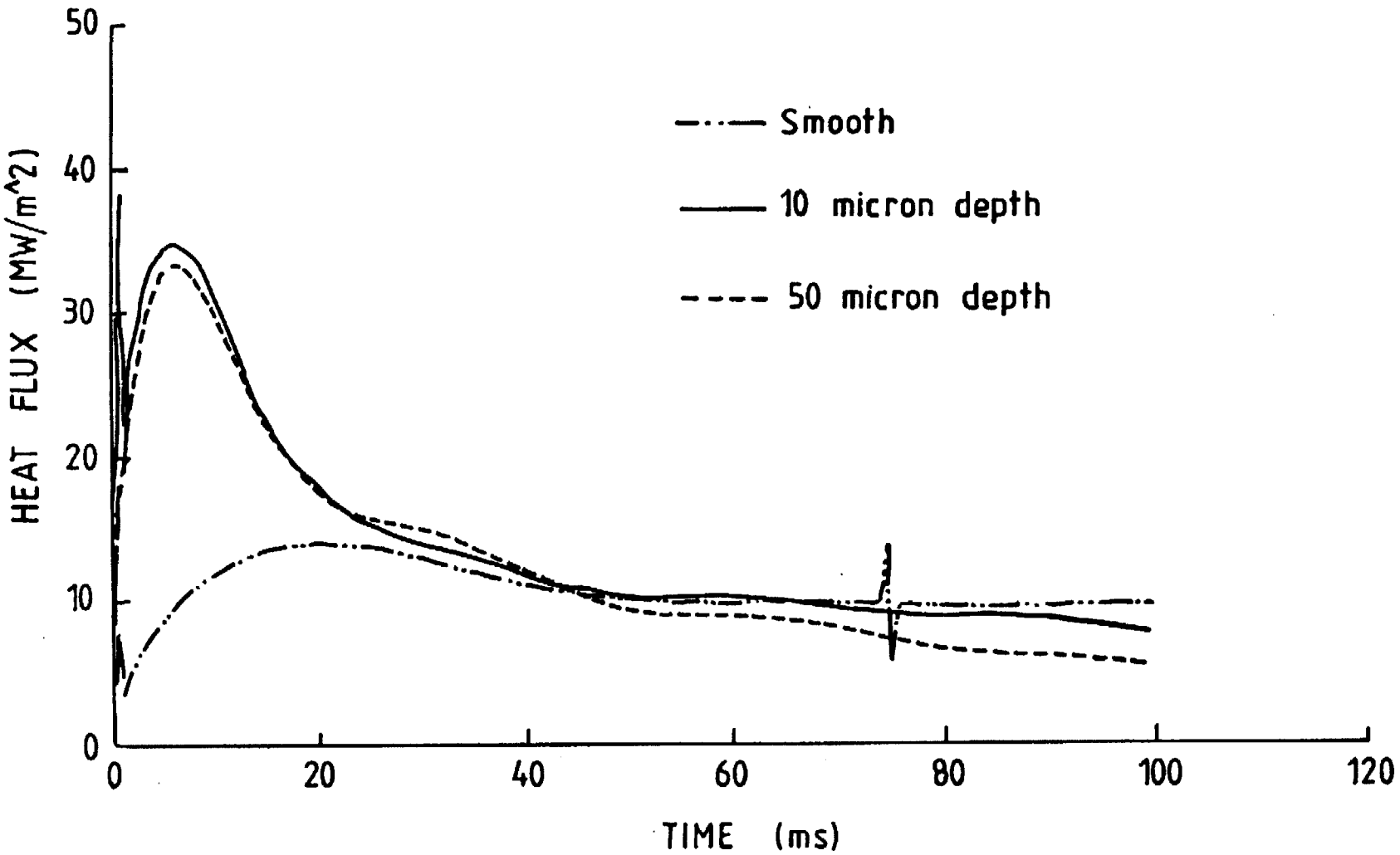
FIG. 14 indicates heat flux values obtained during solidification of steel samples on ridged textured of 10 micron and 50 micron depth and compares these with solidification on a smooth substrate.

The effect of increasing depth of texture on heat transfer through the substrate is illustrated by FIGS. 13 and 14. FIG. 13 shows calculated heat flux values across the texture valley for a wide range of texture depths. FIG. 14 plots heat flux values obtained during solidification of steel samples on ridged textures of 10 micron depth and 50 micron depth and compares these with solidification on a smooth substrate. Both textured surfaces provided higher heat flux values during initial solidification bet it will be seen that the heat flux obtained with the texture of 50 micron depth fell away to low values as solidification progressed. This effect becomes more pronounced if the texture depth is increased. For these reasons the texture depth should be between 5 microns and 50 microns. For ease of machining and to obtain optimum heat flux it is preferred that the texture depth be between 10 microns and 30 microns. Particularly good results have been achieved with a texture depth of 20 microns.

As a result of the test program described above it has been determined that optimum results can be achieved if the casting surfaces have a texture of regular ridges and grooves with a texture pitch between 150 microns and 250 microns and a texture depth between 5 microns and 50 microns. A texture having a depth of 20 microns and a pitch of 180 microns is particularly effective. These results have been confirmed by operation of a twin roll caster with rolls having ridged textures of the kind determined by the experimental program to be the optimum. It has been found that these can produce strip of good quality with rapid solidification in conformity with the experimental results. It has been found that with some steels, however, particularly manganese/silicon killed steels the textured casting surfaces can produce localised excessive cooling during the early stages of solidification leading to localised deformation defects known as "crocodile skin". We have now determined that this problem can be overcome by controlled addition of sulphur to the steel melt.

Figure 15:
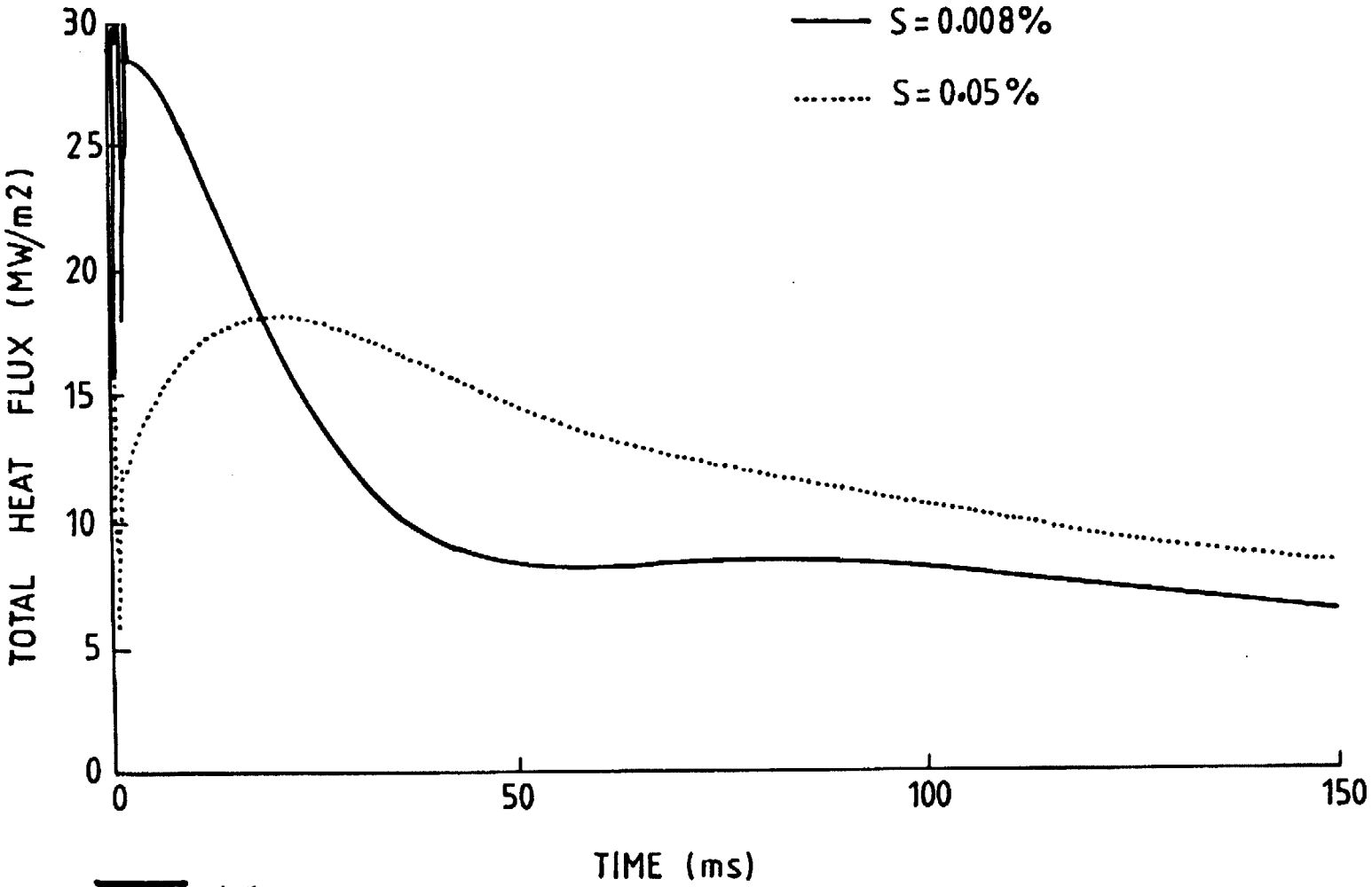
FIG. 15 displays results of solidification tests on steel melts of varying sulphur content on a textured substrate.
Figure 16:
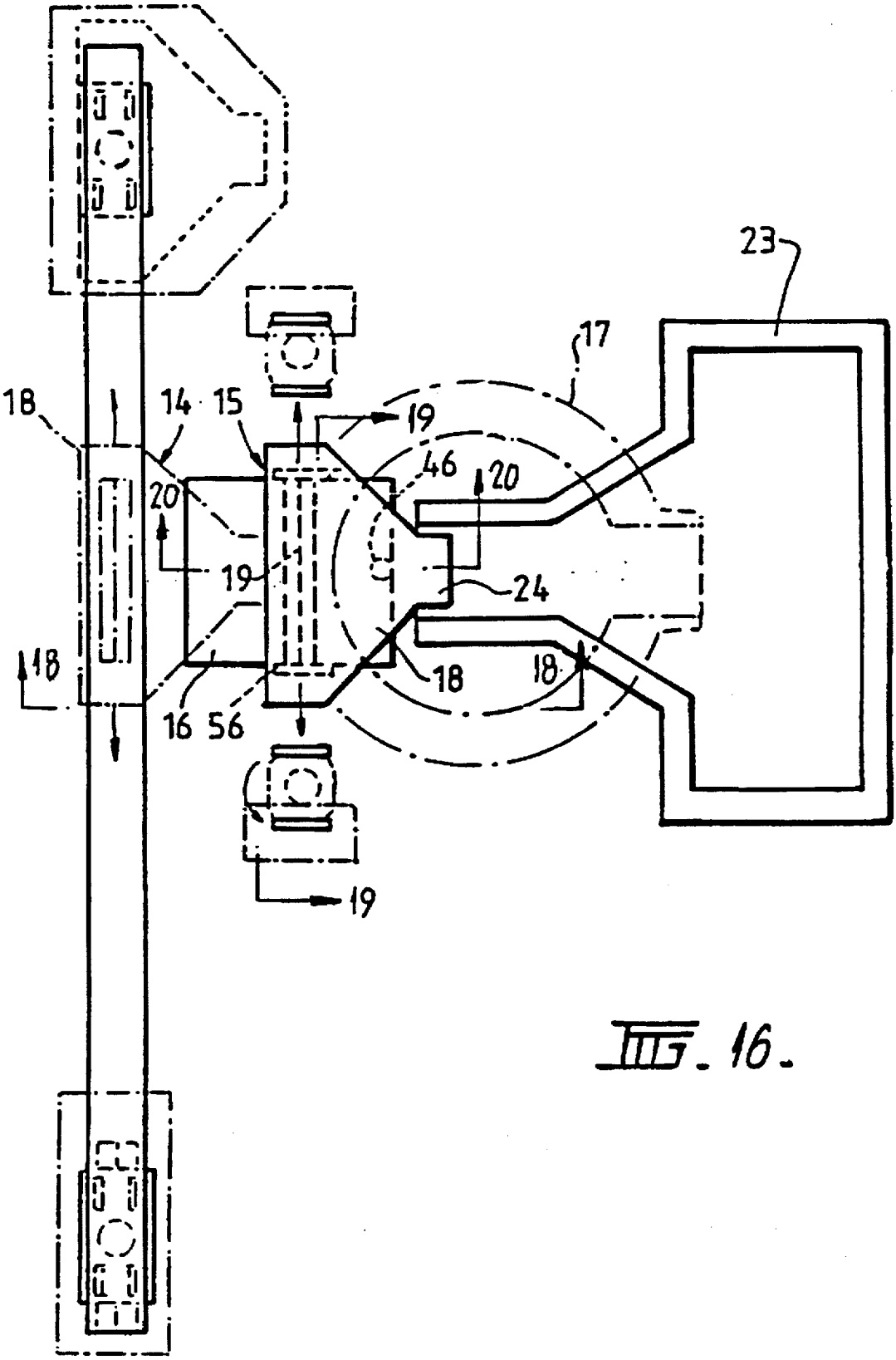
FIG. 16 is a plan view of a continuous strip caster.
Figure 17:
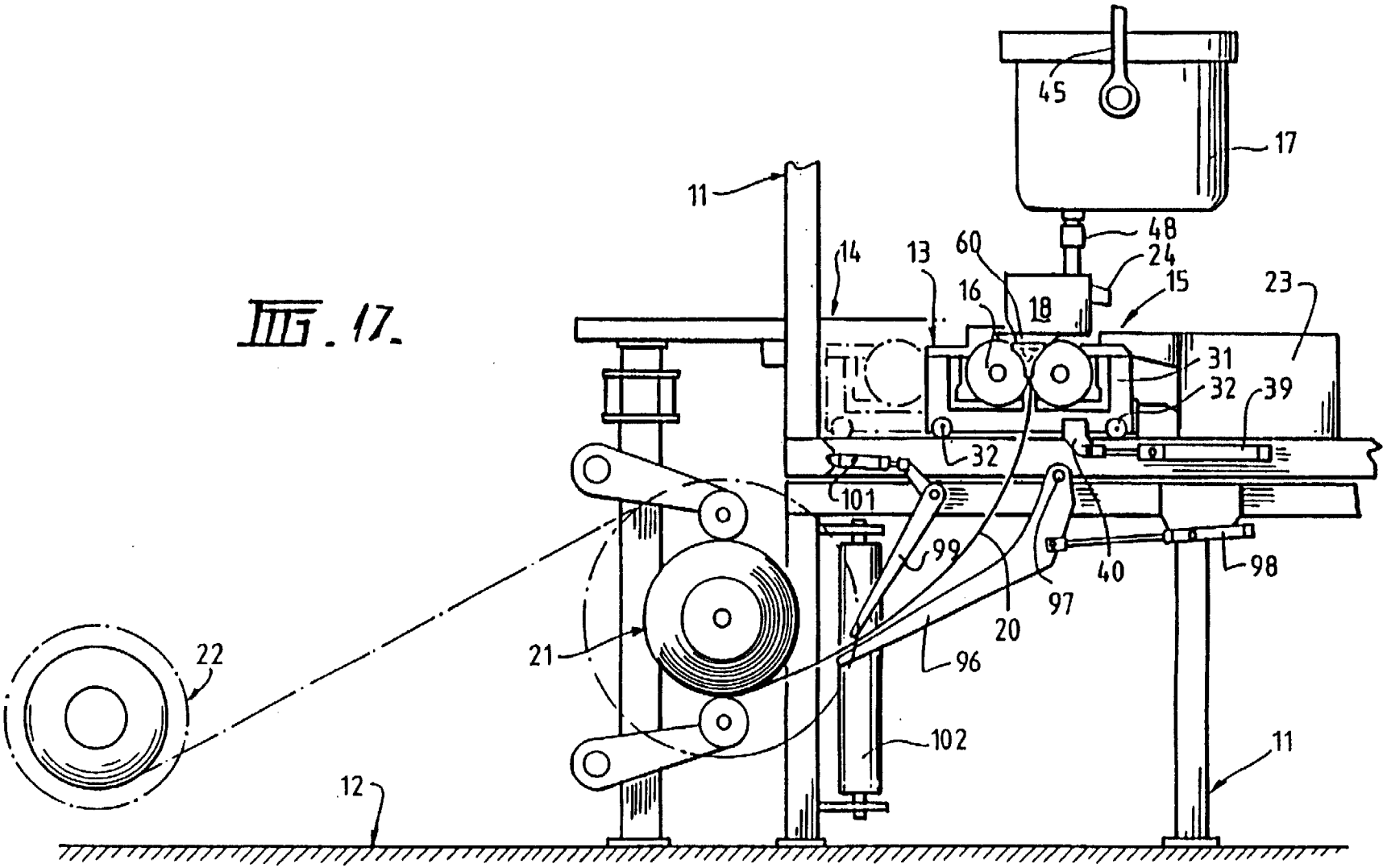
FIG. 17 is a side elevation of the strip caster shown in FIG. 16.
Figure 18:
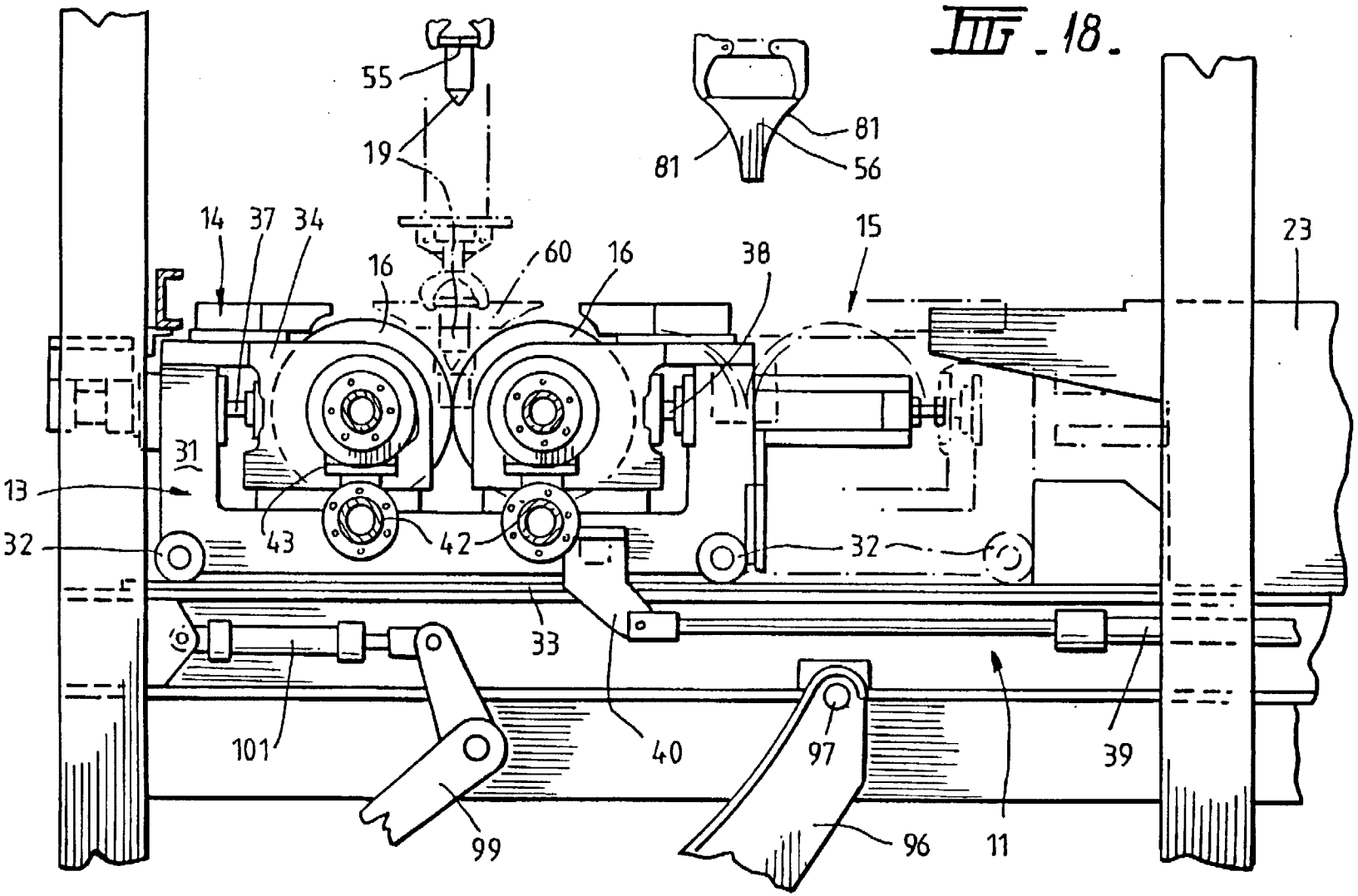
FIG. 18 is a vertical cross-section on the line 18—18 in FIG. 16.
Figure 19:
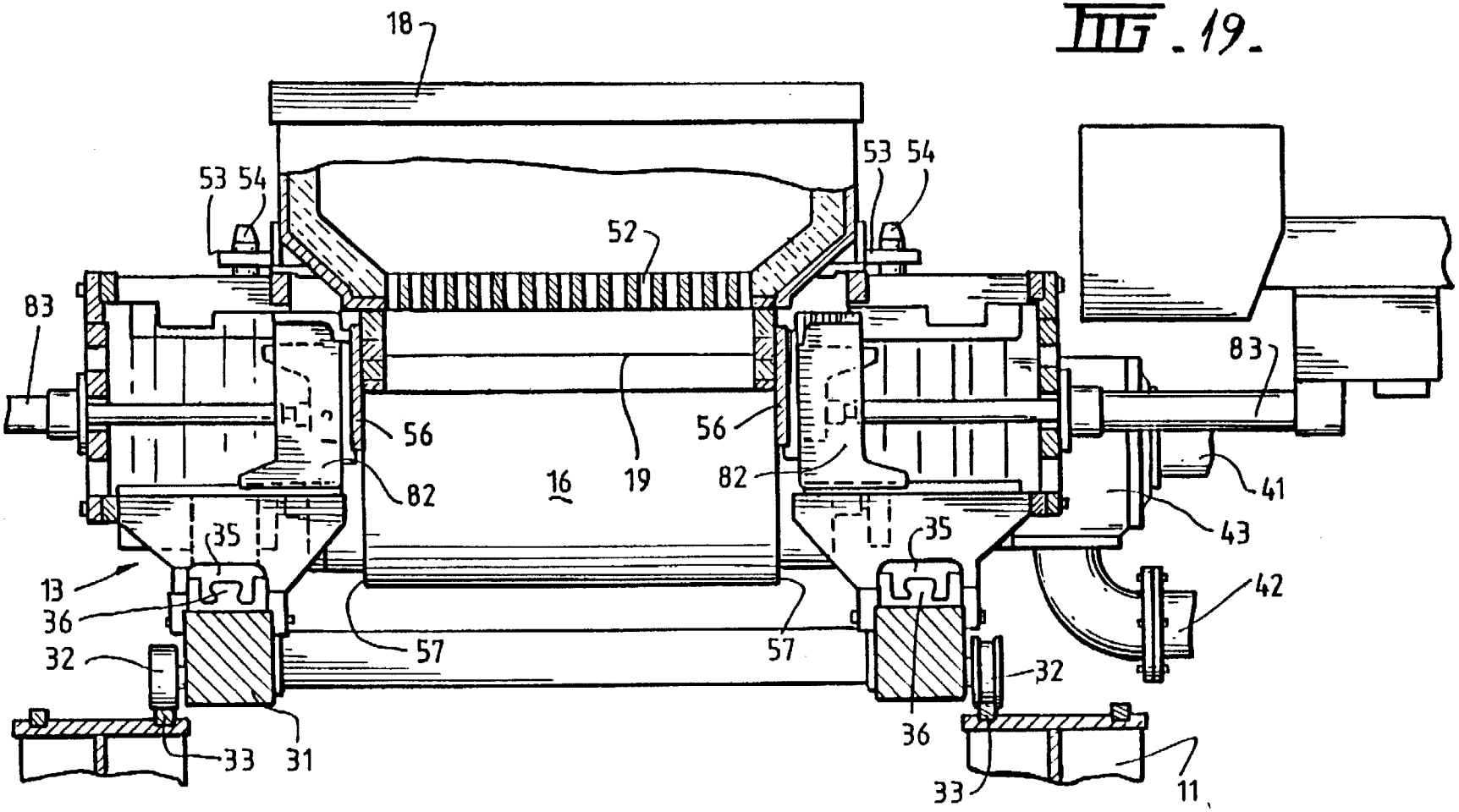
FIG. 19 is a vertical cross-section on the line 19—19 in FIG. 16.
Figure 20:
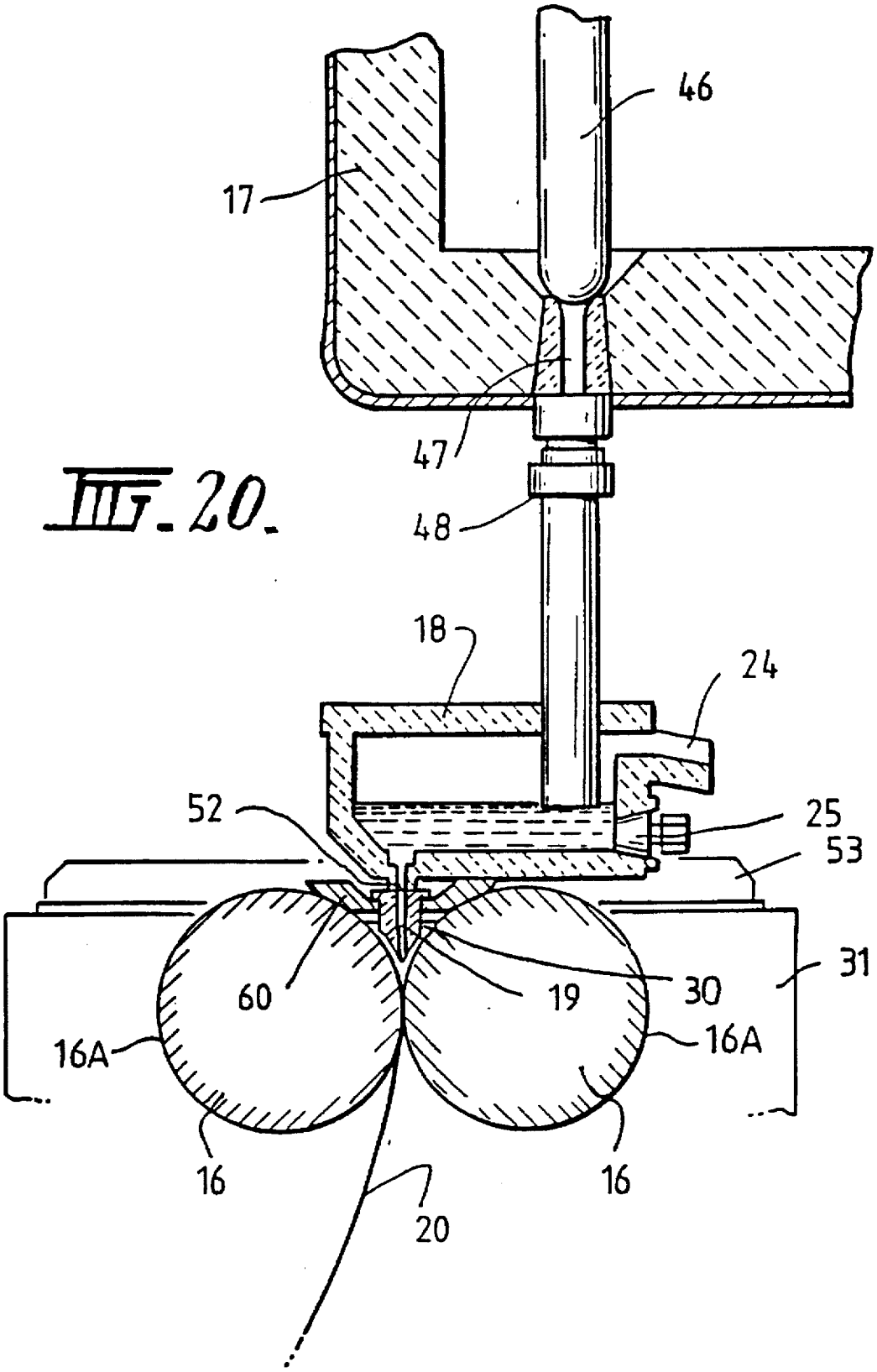
FIG. 20 is a vertical cross-section on the line 20—20 in FIG. 16.

FIG. 15 displays the results of solidification tests on steel melts of varying sulphur content on a textured substrate. More particularly the substrate was provided with parallel grooves 20 microns deep and spaced 180 microns apart. The steel melt compositions had a carbon content of 0.065%, a manganese content of 0.6% and a silicon content of 0.28%. The melts were held at a temperature of 1580° C. It will be seen that the increase in sulphur content significantly reduced the heat flux measured during the early stages of solidification but slightly increased the heat flux throughout later stages of the solidification period. Accordingly the sulphur addition had the effect of smoothing out the heat flux measurements and eliminating a transient peak at the early stage of solidification. It is believed that the localised excessive cooling is associated with the onset of roll oxide melting and that this is delayed by the presence of the increased sulphur content.

FIGS. 16 to 20 illustrate a twin roll continuous strip caster which has been operated in accordance with the present invention. This caster comprises a main machine frame 11 which stands up from the factory floor 12. Frame 11 supports a casting roll carriage 13 which is horizontally movable between an assembly station 14 and a casting station 15. Carriage 13 carries a pair of parallel casting rolls 16 to which molten metal is supplied during a casting operation from a ladle 17 via a tundish 18 and delivery nozzle 19 to create a casting pool 30. Casting rolls 16 are water cooled so that shells solidify on the moving roll surfaces 16A and are brought together at the nip between them to produce a solidified strip product 20 at the roll outlet. This product is fed to a standard coiler 21 and may subsequently be transferred to a second coiler 22. A receptacle 23 is mounted on the machine frame adjacent the casting station and molten metal can be diverted into this receptacle via an overflow spout 24 on the tundish or by withdrawal of an emergency plug 25 at one side of the tundish if there is a severe malformation of product or other severe malfunction during a casting operation.

Roll carriage 13 comprises a carriage frame 31 mounted by wheels 32 on rails 33 extending along part of the main machine frame 11 whereby roll carriage 13 as a whole is mounted for movement along the rails 33. Carriage frame 31 carries a pair of roll cradles 34 in which the rolls 16 are rotatably mounted. Roll cradles 34 are mounted on the carriage frame 31 by interengaging complementary slide members 35, 36 to allow the cradles to be moved on the carriage under the influence of hydraulic cylinder units 37, 38 to adjust the nip between the casting rolls 16. The carriage is movable as a whole along the rails 33 by actuation of a double acting hydraulic piston and cylinder unit 39, connected between a drive bracket 40 on the roll carriage and the main machine frame so as to be actuable to move the roll carriage between the assembly station 14 and casting station 15 and vice versa.

Casting rolls 16 are contra rotated through drive shafts 41 from an electric motor and transmission mounted on carriage frame 31. Rolls 16 have copper peripheral walls formed with a series of longitudinally extending and circumferentially spaced water cooling passages supplied with cooling water through the roll ends from water supply ducts in the roll drive shafts 41 which are connected to water supply hoses 42 through rotary glands 43. The roll may typically be about 500 mm diameter and up to 2000 mm long in order to produce approximately 2000 mm wide strip product.

Ladle 17 is of entirely conventional construction and is supported via a yoke 45 on an overhead crane whence it can be brought into position from a hot metal receiving station. The ladle is fitted with a stopper rod 46 actuable by a servo cylinder to allow molten metal to flow from the ladle through an outlet nozzle 47 and refractory shroud 48 into tundish 18.

Tundish 18 is also of conventional construction. It is formed as a wide dish made of a refractory material such as magnesium oxide (MgO). One side of the tundish receives molten metal from the ladle and is provided with the aforesaid overflow 24 and emergency plug 25. The other side of the tundish is provided with a series of longitudinally spaced metal outlet openings 52. The lower part of the tundish carries mounting brackets 53 for mounting the tundish onto the roll carriage frame 31 and provided with apertures to receive indexing pegs 54 on the carriage frame so as to accurately locate the tundish.

Delivery nozzle 19 is formed as an elongate body made of a refractory material such as alumina graphite. Its lower part is tapered so as to converge inwardly and downwardly so that it can project into the nip between casting rolls 16. It is provided with a mounting bracket 60 whereby to support it on the roll carriage frame and its upper part is formed with outwardly projecting side flanges 55 which locate on the mounting bracket.

Nozzle 19 may have a series of horizontally spaced generally vertically extending flow passages to produce a suitably low velocity discharge of metal throughout the width of the rolls and to deliver the molten metal into the nip between the rolls without direct impingement on the roll surfaces at which initial solidification occurs. Alternatively, the nozzle may have a single continuous slot outlet to deliver a low velocity curtain of molten metal directly into the nip between the rolls and/or it may be immersed in the molten metal pool.

The pool is confined at the ends of the rolls by a pair of side closure plates 56 which are held against stepped ends 57 of the rolls when the roll carriage is at the casting station. Side closure plates 56 are made of a strong refractory material, for example boron nitride, and have scalloped side edges 81 to match the curvature of the stepped ends 57 of the rolls. The side plates can be mounted in plate holders 82 which are movable at the casting station by actuation of a pair of hydraulic cylinder units 83 to bring the side plates into engagement with the stepped ends of the casting rolls to form end closures for the molten pool of metal formed on the casting rolls during a casting operation.

During a casting operation the ladle stopper rod 46 is actuated to allow molten metal to pour from the ladle to the tundish through the metal delivery nozzle whence it flows to the casting rolls. The clean head end of the strip product 20 is guided by actuation of an apron table 96 to the jaws of the coiler 21. Apron table 96 hangs from pivot mountings 97 on the main frame and can be swung toward the coiler by actuation of an hydraulic cylinder unit 98 after a head end of the strip has been formed. Table 96 may operate against an upper strip guide flap 99 actuated by a piston and a cylinder unit 101 and the strip product 20 may be confined between a pair of vertical side rollers 102. After the head end has been guided in to the jaws of the coiler, the coiler is rotated to coil the strip product 20 and the apron table is allowed to swing back to its inoperative position where it simply hangs from the machine frame clear of the product which is taken directly onto the coiler 21. The resulting strip product 20 may be subsequently transferred to coiler 22 to produce a final coil for transport away from the caster.

Full particulars of a twin roll caster of the kind illustrated in FIGS. 16 to 20 are more fully described in our U.S. Pat. Nos. 5,184,668 and 5,277,243 and International Patent Application PCT/AU93/00593 .

In accordance with the present invention the peripheral surfaces 100 of the casting rolls 16 are textured by the provision of regularly spaced V-shaped annular grooves to produce the required ridged texture. For the solidification of steel, it is preferred that the casting surfaces be chrome-plated and then machined to the texture so that the casting surfaces are chromium surfaces. For ease of machining, it is preferred to machine successive separate annular grooves at regularly spacing along the length of the roll. However, it will be appreciated that essentially the same textured formation could be produced by helical grooves machined in the casting surface in the manner of a single start or a multi-start thread. This would make no difference to the essential shape of the groove and ridge formations or to the heat transfer characteristics of the texture.

We claim:

1. A method of continuously casting steel strip comprising supporting a casting pool of molten steel on one or more chilled casting surfaces and moving the chilled casting surface or surfaces to produce a solidified strip moving away from the casting pool, wherein the or each casting surface is textured by the provision of parallel groove and ridge formations of essentially constant depth and pitch, the depth of the texture from ridge peak to groove root being in the range 5 microns to less than 50 microns, and said pitch being in the range 100 to 250 microns.

2. A method as claimed in claim 1, wherein the casting pool is supported on peripheral casting surfaces of a pair of chilled casting rolls forming a nip between them and rotated in mutually opposite directions to produce the solidified strip such that it moves downwardly from the nip.

3. A method as claimed in claim 2, wherein the groove and ridge formations in each casting surface are defined by a series of parallel annular grooves extending circumferentially around the casting surface and regularly spaced longitudinally of the casting surface at said pitch.

4. A method as claimed in claim 3, wherein the groove and ridge formations in each casting surface are defined by one or more grooves extending helically of the casting surface.

5. A method as claimed in claim 1, wherein the groove formations are of substantially V-shaped cross-section and the ridge formations have sharp circumferential edges.

6. A method as claimed in claim 1, in which the depth of the texture is in the range 15 to 25 microns and said pitch is between 150 and 200 microns.

7. A method as claimed in claim 6, wherein the depth of the texture is about 20 microns and said pitch is about 180 microns.

8. A method as claimed in claim 1, wherein the casting surfaces are chromium surfaces.

9. A method as claimed in claim 1, wherein the molten steel has a sulphur content of at least 0.02%.

10. A method as claimed in claim 9, wherein the molten steel is a silicon/manganese killed steel having a manganese content of not less than 0.20% and a silicon content of not less than 0.10% by weight.

11. A method as claimed in claim 9, wherein the sulphur content of the steel is no less than 0.03% by weight.

12. A method as claimed in claim 11, wherein the sulphur content of the steel is in the range 0.03 to 0.07% by weight.

13. A method as claimed in claim 1, wherein the casting pool is supported on peripheral casting surfaces of a pair of chilled casting rolls forming a nip between them and rotated in mutually opposite directions to produce the solidified strip such that it moves downwardly from the nip. The groove and ridge formations extend circumferentially of the casting surfaces of the rolls, the groove formations are of substantially V-shaped cross-sections and the ridge formations have sharp circumferential edges.

14. A method as claimed in claim 13, wherein the depth of the texture is in the range 15 to 25 microns and said pitch is between 150 and 200 microns.

15. A method as claimed in claim 14, wherein the depth of the texture is about 20 microns and said pitch is about 180 microns.

16. A method as claimed in claim 13, wherein the casting surfaces are chromium surfaces.

17. A method as claimed in claim 13, wherein the molten steel has a sulphur content of at least 0.02%.

18. A method as claimed in claim 16, wherein the molten steel is a silicon/manganese killed steel having a manganese content of not less than 0.02% and a silicon content of not less than 0.10% by weight.

19. Apparatus for continuously casting steel strip comprising a pair of casting rolls forming a nip between them, a metal delivery nozzle for delivery of molten steel into the nip between the casting rolls to form a casting pool of molten metal supported on casting roll surfaces immediately above the nip, and roll drive means to drive the casting rolls in counter-rotational directions to produce a solidified steel strip delivered downwardly from the nip, wherein the casting surfaces of the rolls are textured by the provision of circumferentially extending groove and ridge formations of constant depth and pitch, the depth of the texture from ridge peak to groove root being in the range 5 microns to less than 50 microns, and said pitch being in the range 100 to 250 microns.

20. Apparatus as claimed in claim 19, wherein the groove and ridge formations in each casting surface are defined by a series of parallel annular grooves extending circumferentially around the casting surface and regularly spaced longitudinally of the casting surface at said pitch.

21. Apparatus as claimed in claim 19, wherein the groove and ridge formations in each casting surface are defined by one or more grooves extending helically of the casting surface.

22. Apparatus as claimed in claim 19, wherein the grooves of the casting surfaces are of substantially V-shaped cross-section and the ridge formations have sharp circumferential edges.

23. Apparatus as claimed in claim 19, wherein the depth of the texture of the casting surfaces is in the range 15 to 25 microns and said pitch is between 150 and 200 microns.

24. Apparatus as claimed in claim 23, wherein the depth of the texture in the casting surfaces is about 20 microns and said pitch is about 180 microns.

* * * * *